United States Patent [19]

Aikou et al.

[11] Patent Number: 4,712,477

[45] Date of Patent: Dec. 15, 1987

[54] ELECTRONIC DELAY DETONATOR

[75] Inventors: Kenichi Aikou; Yoichi Kurihara; Tsugio Goto, all of Nobeoka, Japan

[73] Assignee: Asahi Kasei Kogyo Kabushiki Kaisha, Osaka, Japan

[21] Appl. No.: 871,487

[22] Filed: Jun. 6, 1986

[30] Foreign Application Priority Data

Jun. 10, 1985 [JP] Japan ..... 60-124181

[51] Int. Cl.[4] ..... F42C 11/00

[52] U.S. Cl. ..... 102/206; 102/202.5; 102/217

[58] Field of Search ..... 102/206, 217, 202.5, 102/202.3, 200, 220

[56] References Cited

U.S. PATENT DOCUMENTS

| | | | |
|---|---|---|---|
| 1,959,479 | 5/1934 | Kielczewski | 102/206 |
| 4,050,382 | 9/1977 | Power | 102/206 |
| 4,145,970 | 3/1979 | Hedberg et al. | 102/206 |
| 4,311,096 | 1/1982 | Oswald | 102/220 |
| 4,328,751 | 5/1982 | Oswald | 102/220 |
| 4,393,779 | 7/1983 | Brede et al. | 102/202.5 |
| 4,395,950 | 8/1983 | Oswald | 102/206 |
| 4,445,435 | 5/1984 | Oswald | 102/206 |
| 4,487,125 | 12/1984 | Zuk | 102/206 |
| 4,586,437 | 5/1986 | Miki et al. | 102/206 |

FOREIGN PATENT DOCUMENTS

| | | | |
|---|---|---|---|
| 0093804 | 12/1982 | European Pat. Off. . | |
| 142496 | 9/1982 | Japan | 102/220 |
| 2153495 | 8/1985 | United Kingdom | 102/206 |

*Primary Examiner*—Charles T. Jordan

*Attorney, Agent, or Firm*—Finnegan, Henderson, Farabow, Garrett & Dunner

[57] ABSTRACT

An electronic delay detonator for igniting an ignition resistor a predetermined delay time after supply of electric power from a blasting machine comprises two input terminals for receiving the electric power supplied from the blasting machine, a diode-bridge circuit connected to the input terminals, a power supply capacitor connected to the output of the diode bridge circuit, an RC charging circuit connected in parallel with the capacitor and having a predetermined time constant, and a monolithic IC. The monolithic IC includes a reference generation circuit for generating a compare reference voltage by dividing the power supply by dividing resistors, a voltage comparator for comparing the voltage charged in the capacitor of the charging circuit with the compare reference voltage, a signal latch circuit for holding the output of the comparator and a transistor current switching circuit responsive to the output of the signal latch circuit to for supplying the electric energy of the power supply capacitor to the ignition resistor of the detonator. The overall circuit is in a hybrid IC module. A resistor having a constant resistance sufficiently distinguishable from an internal resistance of the detonator is connected across the two input terminals to bypass a stray current and enable checking of connection continuity of series-connected detonators.

12 Claims, 8 Drawing Figures

ELECTRONIC DELAY DETONATOR

BACKGROUND OF THE INVENTION

The present invention relates to an electric detonator having an electronic delay ignitor, and more particularly to a hybrid IC ignition circuit to be packaged in an electric detonator.

Prior art electric detonators having electronic delay ignitors are disclosed in U.S. Pat. Nos. 4,311,096, 4,445,435, 4,586,437 issued on May 6, 1986 and owned by the present assignee and Japanese Patent Application Laid-Open No. 57-142496 laid open on Sept. 3, 1982 and invented by two of the present inventors. The detonator is intended to initiate explosion of explosives such as dynamite or water gel explosive. Those are electric detonators each having an electronic ignition circuit including an energy storing capacitor, an electronic delay circuit and a switching element. The detonator is ignited by supplying a charge stored in the capacitor to a detonator ignition resistor through a switching element a predetermined time after discharging of a blasting machine.

In the detonator which uses analog delay means comprising a capacitor C and a resistor R as disclosed in U.S. Pat. 4,311,096 and Japanese Patent Application Laid-Open No. 57-142496, a timing precision is significantly influenced by an applied voltage, a temperature change and variance in individual components and hence it has a problem in practical use. The timing precision or delay accuracy of such detonator is not much different than that of a prior art delay powder type electric detonator.

When the analog delay switching circuit having a capacitor (C) 9 and a resistor (R) 8 shown in FIG. 6 is implemented by a monolithic IC, it is difficult in manufacture to integrate a switching thyristor (SCR) 19 and a PUT (programmable unijunction transistor) 18 having reference voltage resistors 5 and 6 connected thereto into the monolithic IC. Even if they are integrated, a power supply capacitor 7 must be large because of an insufficient delay accuracy and a large current consumption. Accordingly, it is not appropriate to the IC delay element of the electric detonator.

In addition, since the electronic delay detonator contains the energy storing power supply capacitor 7, if input terminals 10 and 11 are opened, an external stray current is gradually stored in the energy storing power supply capacitor 7 through an input line.

As the amount of stored charge increases, the stored charge activates the delay switching circuit so that a trigger signal is applied to the switching element 19 such as a thyristor and the ignition charge stored in the capacitor 7 flows into an ignition resistor wire 16 through the switching element 19 to heat the resistor wire 16. As a result, the detonator is ignited inadvertently.

The amount of stored charge depends on whether the stray current is pulsive (single pulse or repetitive pulse) or continuous. When the stray current is continuous, the electronic delay detonator is fired in several seconds to several tens of seconds when the stray current is approximately 2 mA at 10 volts. Further, in those electronic delay detonators, inconveniently it is not possible to check and measure continuity and series-connection resistance. The problems in the stray current and continuity check of the detonator also apply to a detonator with digital delay means to be described below.

The detonator having digital delay means as disclosed in U.S. Pat. Nos. 4,445,435 and 4,586,437 has a more accurate timing precision than that of the analog delay switching circuit but it is not practical to use in a disposable detonator because it must use an expensive quartz resonator or ceramic resonator. If a relatively inexpensive CR oscillator is used, an oscillation IC and a counter IC are required and a separate current switching element (for example SCR) must be provided. As a result, it is difficult to integrate those elements in one chip and size reduction is restricted.

SUMMARY OF THE INVENTION

It is an object of the present invention to provide a compact, low cost and highly reliable electronic delay detonator which consumes a low amount of power and is suitable for disposable use.

It is another object of the present invention to provide an electronic delay detonator which prevents malfunction due to a stray current.

It is a further object of the present invention to provide an electronic delay detonator of a configuration in which proper electrical connection and the number of connections of plural detonators can be readily checked by electrical means and can be used in blasting work using a large number of detonators.

In order to achieve the above objects, and in accordance with the present invention, there is provided an electronic delay detonator having an electronic delay timer switch comprising a power supply circuit, an electrical energy storing capacitor (power supply capacitor) for a timer and ignition, a CR charging circuit which functions as a delay element and has an output of the power input circuit applied thereto, a compare reference voltage generating circuit which divides the output of the power supply circuit by a ratio of resistors, a voltage comparator which compares a voltage stored in a capacitor of the CR charging circuit with the compare reference voltage, a signal latch circuit, and a detonator ignition current switching circuit which is activated by an output of the signal latch circuit. The latch circuit may be dispensed with by bearing a latch function to the voltage comparator or the current switching circuit. The power supply circuit, the compare reference voltage generating circuit, the latch circuit and the switching circuit are integrated into a monolithic IC and the entire assembly is assembled into a hybrid IC.

In accordance with one feature of the electronic delay detonator of the present invention, the monolithic IC of the electronic ignition timer switch includes the power input circuit, the compare reference voltage generating circuit, the voltage comparator, the latch circuit and the switching circuit. It may be possible to integrate those circuits and the CR charging circuit into the monolithic IC for a limited short time setting, however, it is preferable to arrange the CR charging circuit externally of the monolithic IC in order to obtain a practical delay time (~8 seconds) of the electronic delay detonator and allow setting of any desired delay time. If the IC which integrates the power supply circuit therein is difficult to attain, the power supply circuit may be arranged externally to form a hybrid IC.

Due to use of the power supply capacitor of an appropriate diameter (about 6 mm to 10 mm) to the detonator, the monolithic IC which includes the compare reference voltage generating circuit, the voltage comparator, the latch circuit and the switching circuit must meet electrical characteristics of input voltage; lower than 20 V, circuit consumption current when the switch is off; lower than 700–800 mA (a long-time timer is attained by suppressing the circuit consumption current), a switching circuit saturation voltage; lower than 2 V (when output current is 1A), and a maximum allowable output current; 10A. Thus, a voltage drop during the circuit operation is suppressed, the use of a small diameter capacitor (small capacity capacitor) is permitted, and the electronic delay detonator having suitable shape and size (e.g. a diameter of about 6 to 10 mm and a length of lower than 100 mm) for the ignition is provided.

When the input voltage is lower than 20 V and the timing precision of the detonator is to be less than 0.1% with the exception of variation of the individual elements, it is preferable that the sensitivity of the voltage comparator be larger than 12 mV, an offset voltage be less than several mV, and an input impedance be higher than 100 MΩ.

The present detonator with the electronic timer switch can be readily constructed by separately manufacturing and electronic timer switch and connecting it to a leg wire of a conventional detonator.

In accordance with another feature of the present invention, resistor means is connected to an input terminal of the electronic delay detonator in parallel with the power supply capacitor of the detonator to bypass a stray current thereto.

For the electronic delay detonator of the present invention, various tests were made for the stray current and it was found that the electronic delay detonator is not ignited if the resistance of the resistor means is substantially 10–500Ω for a continuous stray current of a low current (lower than 0.3 A) and a low voltage (lower than 20 V). In order to allow connection-continuity checking and counting of the number of connected detonators effectively, it is preferable that the resistance is selected between 100–200Ω.

DESCRIPTION OF THE PREFERRED EMBODIMENTS

Figure 1:
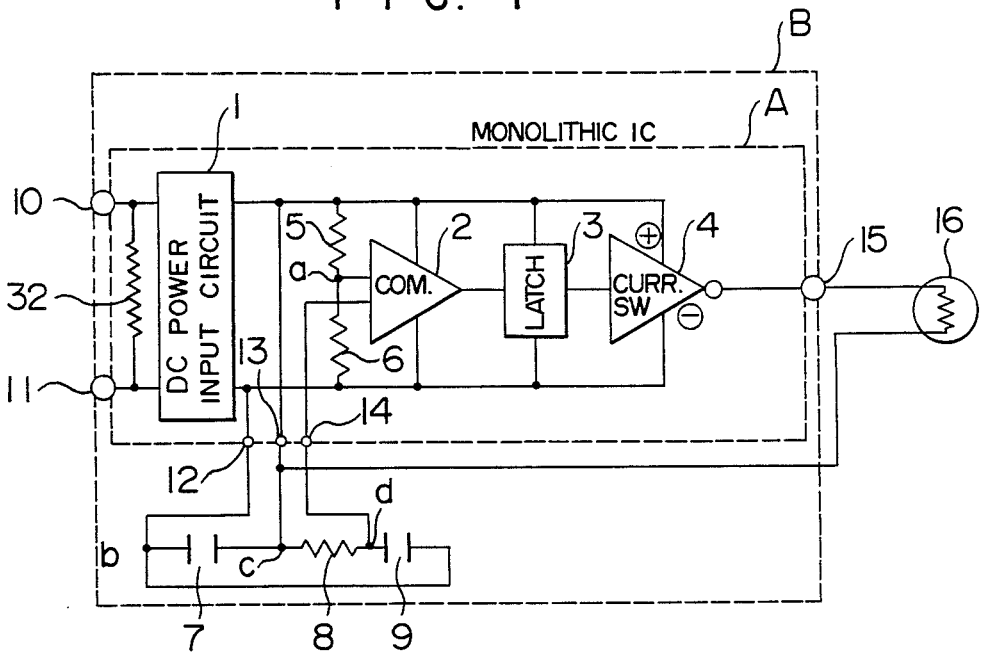
FIG. 1 is a block diagram of a circuit of an embodiment of an electronic delay detonator of the present invention.

FIG. 1 shows a block diagram of an electronic timer switch in accordance with one embodiment of the present invention.

A chain line block A is a circuit in a monolithic IC structure (semiconductor chip). A size of the semiconductor chip is approximately 2 mm square. A block B is a substrate made of glass epoxy or ceramic, or a film carrier wiring portion. The semiconductor chip of the block A comprises a power input circuit 1 usually formed of a diode bridge, a voltage comparator 2, a latch circuit 3, a detonator ignition current switching circuit 4, a voltage divider including series-connected resistors 5 and 6 for generating a compare reference voltage, power supply terminals 10 and 11 adapted to connect to a blasting machine, negative and positive DC power supply terminals 12 and 13, a voltage comparator input terminal 14 and a switch output terminal 15 for establishing a current path for an ignition resistor 16 made of e.g. platinum wire.

The substrate B comprises, as off-chip elements of the IC chip A, a capacitor (power supply capacitor) 7 for storing electrical charge for timer operation and ignition, and a resistor 8 and a capacitor 9 which form a delay time constant circuit.

Configuration and function of the IC chip are explained by an equivalent circuit. The power input circuit (which is powered by D.C. power from the blasting machine to form a unidirectional circuit) is practically essential as disclosed in U.S. Pat. No. 4,586,437 of the present assignee and it is a DC power supply rectification and supply circuit by which power lines from the blasting machine may be freely connected with the input terminals regardless of polarity. In the equivalent circuit, rectifier elements each having a current of 0.5 A–1 A are configured into a bridge rectifier circuit or a half wave rectifier circuit. Essentially, a resistor 32 for bypassing the stray current is connected across the input terminals 10 and 11.

The DC output terminals of the power input circuit 1 are connected to the positive (+) power supply terminal 13 and the negative (−) power supply terminal 12, and the junction a of the dividing resistors 5 and 6 (having a resistance of 30–100 kΩ) and the voltage comparator input terminal 14 are connected to the respective input terminals of the IC analog voltage comparator 2 of a differential amplifier configuration (having a differential input voltage sensitivity of 3 mV).

The output of the comparator 2 is supplied to the signal latch circuit 3 and the output of the signal latch circuit 3 is supplied to the detonator ignition current switching circuit 4 (peak current: 5.0 A and maximum limit: 10A). The signal latch circuit 3 latches the signal from the voltage comparator 2 so that it sends out a stable signal to the switching circuit 4. If the signal latch function is included in the IC analog voltage comparator 2 or the detonator ignition current switching circuit 4, the signal latch circuit 3 may be omitted.

The detonator ignition current switching circuit 4 establishes a conduction path between the output terminal 15 and the (−) power supply terminal 13, and hence, permits establishment of an igniting discharge path including the above conduction path, the capacitor 7 and an ignition resistor 16.

The power supply capacitor 7 (electrolytic capacitor: 300 μF) is connected off the IC chip to the output terminal of the power input circuit 1, and the time setting resistor 8 (metallic or carbon film resistor: several tens of kΩ to 10 MΩ) and the capacitor 9 (chip capacitor: 0.001–10 μF) are connected in series to the output terminal of the power input circuit. A junction b is connected to the negative (−) DC power supply terminal 12, a junction c is connected to the positive (+) DC power supply terminal 13, and a junction d is connected to the voltage comparator input terminal 14.

The discharge current of the power supply capacitor 7 is supplied up to 10 A in a short time period, such as, less than a few milliseconds, as the timer switch output ignition current, from the + power supply terminal 13 to the ignition resistor 16 of the electric detonator through the output terminal 15, to ignite the electric detonator.

When a voltage of approximately 15 V per detonator is applied for several ms from an external electrical blasting machine through the power supply input terminals 10 and 11, the + voltage is always applied to the + power supply terminal 13 and the − voltage is always supplied to the − power supply terminal 12 by the power input circuit 1 of the diode bridge configuration, and the + voltage is applied to the junction c of the power supply capacitor 7 and the resistor 8 and the − voltage is applied to the junction b of the power supply capacitor 7 and the capacitor 9. As a result, the necessary voltage (approximately 10 V) is stored in the power supply capacitor 7. In this manner, the power supply capacitor 7 stores the charge necessary for the operation of the timer and the charge necessary to ignite the detonator, to a rated voltage.

When a high precision electronic timer is desired, a resistor and a zener diode may be connected to the output of the power input circuit 1 to impart a constant voltage characteristic, as disclosed in the U.S. Pat. No. 4,586,437.

As the power supply capacitor 7 is charged, the capacitor 9 is charged through the resistor 8 for a time period determined by a product of the capacitance of the capacitor 9 and the resistance of the resistor 8, for example, by a time constant of 10—several hundreds ms. The voltage at the junction a of the resistors 5 and 6 and the charge stored in the capacitor 9 are supplied to respective input terminals of the IC analog voltage comparator 2.

In order that a long delay time may be set in a substantially linear charge time-charge voltage characteristic of the time constant circuit 8 and 9, the resistance ratio of the voltage divider resistors 5 and 6 is set to generate a compare reference voltage which is equivalent to a terminal voltage of the time constant circuit 8 and 9 at 1.1 times its time constant after the beginning of charging. For example, the resistance ratio of resistors 5 and 6 may be set at 1:2 and the compare reference voltage applied to the comparator 2 may be set preferably at ⅔ of the power supply voltage.

The power is supplied to the power supply input terminals 10 and 11 to charge the capacitor 9, and, at a predetermined delay time (10—several hundreds ms) after the initiation of the supply of power from the blasting machine, the voltage across the capacitor 9 is approximately 3 mV larger than the divided voltage at the junction a of the resistors 5 and 6. The IC analog voltage comparator 2 produces a voltage signal corresponding to the power supply voltage (approximately equal to the voltage stored in the power supply capacitor 7, for example, approximately 10 V), and it is latched in the signal latch circuit 3. As the signal corresponding to the power supply voltage is latched, the signal latch circuit 3 also produces a voltage approximately equal to the voltage of the power supply capacitor 7 (approximately 10 V), and supplies it to the detonator ignition current switching circuit 4 to turn on the current switching circuit 4 so that a conduction path is established between the output terminal 15 and the (−) power supply terminal 12. As a result, the charge stored in the power supply capacitor 7 flows through the detonator ignition resistor 16, connected externally between the (+) power supply terminal 13 and the output terminal 15, up to 5 A for 0.5—several ms. The detonator ignition resistor 16 is thus ignited with a preset delay time (10—several hundreds ms) after discharging of the blasting machine. Namely, the setting time t of the present electronic timer switch is determined by the time constant of the resistor 8 (R) and the capacitor 9 (C) stated above.

Figure 2:
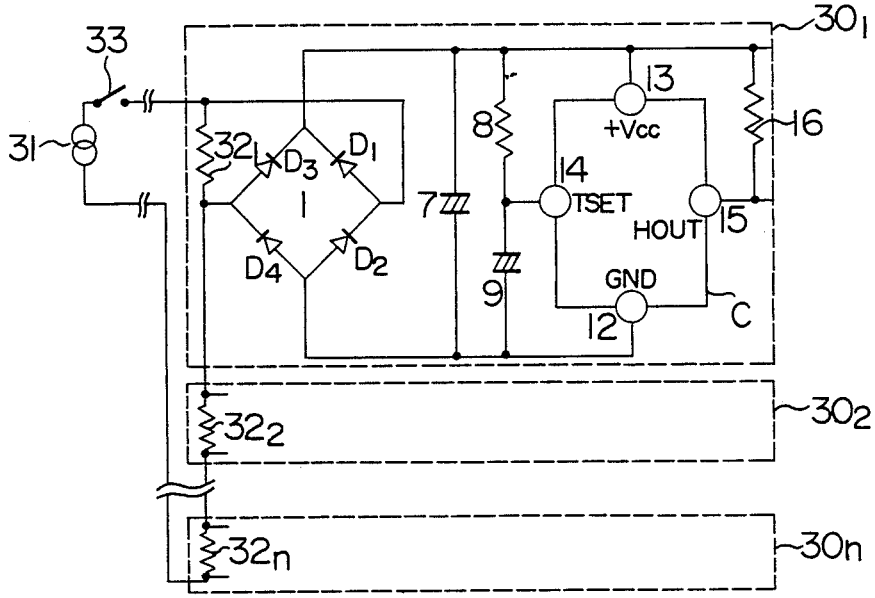
FIG. 2 is a block diagram of a blasting circuit connection of a plurality of electronic delay detonators in accordance with another embodiment of the present invention.

FIG. 2 shows an embodiment of the present invention in which a plurality of detonators essentially shown in FIG. 1 are serially connected to the blasting machine. Numerals $\mathbf{30}_1$, $\mathbf{30}_2$, . . . $\mathbf{30}_n$ denote the detonator ignition circuit blocks, numeral 31 denotes a blasting machine with a fire switch 33 which is usually a variable high voltage supply, and numerals $\mathbf{32}_1$, $\mathbf{32}_2$, . . . $\mathbf{32}_n$ denote stray current bypassing resistors connected across the input terminals 10 and 11.

For example, the energy storing power supply capacitor 7 is an aluminum electrolytic capacitor of 330 μF, the delay capacitor 9 is 0.1 μF. The delay resistor 8 is selected to be 100 kΩ based on a predetermined delay time and the bypassing resistor 32 is 20Ω.

A D.C. continuous current of 0.3 A was supplied to the input terminals 10 and 11 of the electronic delay detonator as the stray current, but the detonator was not ignited. On the other hand, in the electronic delay detonator in which the stray current bypassing resistor 32 was eliminated in the circuit of FIG. 2, the detonator was ignited in 2–3 seconds under the same condition of the stray current.

In the connection circuit of FIG. 2, the detonator ignition circuits $\mathbf{30}_1$, $\mathbf{30}_2$, . . . $\mathbf{30}_n$ are sequentially ignited after the predetermined delay time at a selected time interval between 10–30 ms. As a result, ground vibration is released in a periphery of the blasting point adversely affecting the result. On the basis of the inventors' finding on vibration reduction, the constants of the delay time constant circuits of the ignition circuits are changed by a predetermined increment at a high precision. The resistor 8 and the capacitor 9 of the time constant circuit are preferably arranged off the chip to allow the use and adjustment of different time constants. The substantial time constant adjustment is usually made by selecting the values of the resistor 8 and the capacitor 9 and the fine adjustment is made by trimming the resistor 8.

In the blasting machine circuit of FIG. 2, the number of detonators connected can be counted by providing a conventionally known counter-type (digital) resistance measurement circuit and converting a total resistance of the circuit to the number of electric detonators. For example, if the resistance of the input terminal bypassing resistor 32 is 100Ω and 50 detonators are connected in series, the total resistance is equal to 5 kΩ plus a bus (leading wire) resistance. The internal resistance of the prior art electric detonator is approximately 1Ω, but, the values for detonators are largely uneven due to environmental temperature characteristics and fabrication factors of the ignition resistor (platinum wire). Therefore, it has been difficult to determine the number of connected detonators by measuring the total resistance by the number of detonators. By providing a resistor of a large constant resistance in the preceding stage of the diode-bridge power input circuit of each detonator, the number of connected detonators can be readily determined by measuring the total resistance of the connected detonators since the unevenness of ignition resistances and bus resistance are negligible.

Figure 3:
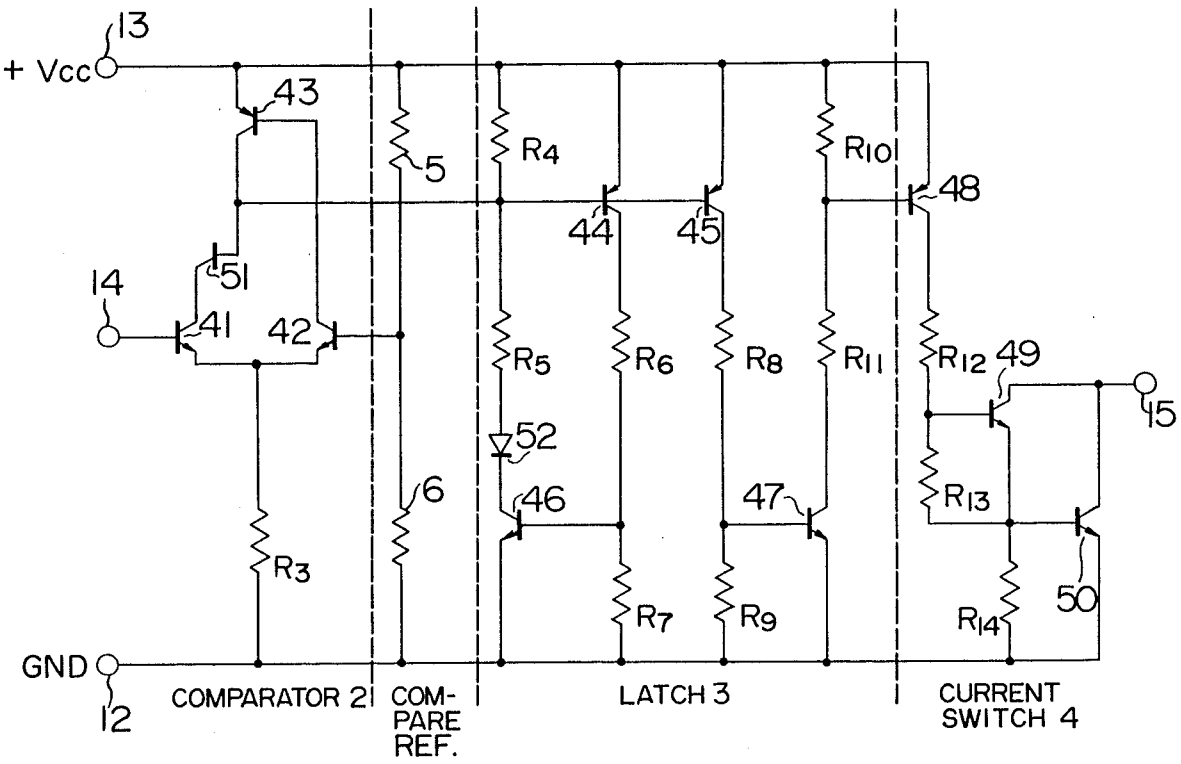
FIG. 3 is a circuit diagram of a monolithic IC in accordance with an embodiment of the present invention.

FIG. 3 shows an embodiment of the block C of the monolithic IC of FIG. 2. Numerals 41–51 denote PNP or NPN transistors, numeral 52 denotes a diode, $R_3$–$R_{14}$ denote resistors, numerals 12 and 13 denote a pair of power supply terminals, numeral 14 denotes a compare input terminal, and numeral 15 denotes an ignition resistance connection terminal. The comparator 2 comprises the differentially connected transistors 41 and 42, diode-connected transistor 51 and the load transistor 43, and the latch circuit 3 comprises the PNP transistors 44 and 45, the signal holding NPN transistor 46, the diode 52 and the output NPN transistor 47. The transistor current switching circuit 4 comprises the input PNP transistor 48, the drive/conduction compensation NPN transistor 49 and the switching NPN transistor 50 for energizing the ignition resistor 16.

Figure 4A:
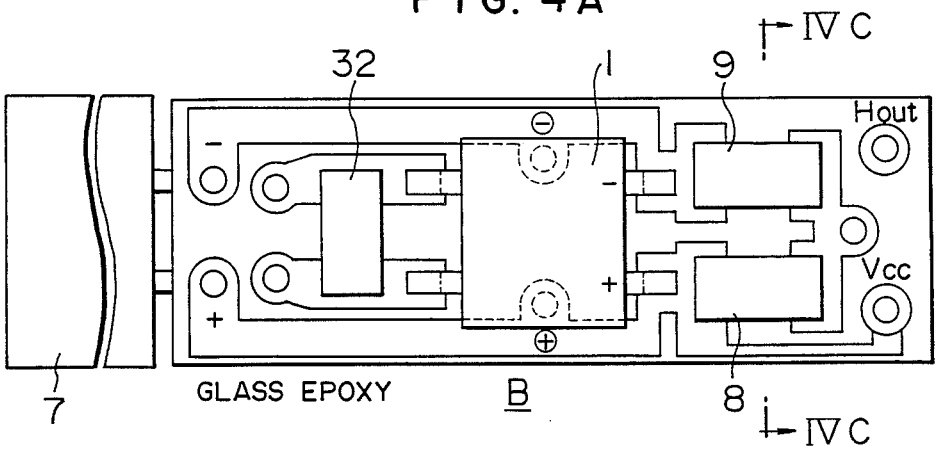
FIG. 4A to 4C are views of a front surface, rear surface and longitudinal section, taken along a line 4C—4C, respectively, of a hybrid circuit board of an electronic ignition circuit for the detonator of the present invention.
Figure 4B:
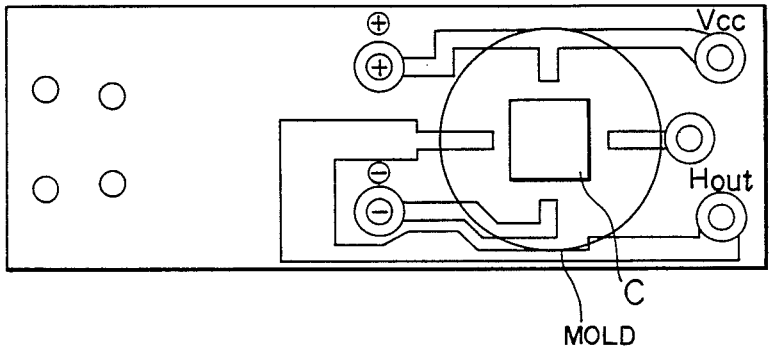
Figure 4C:
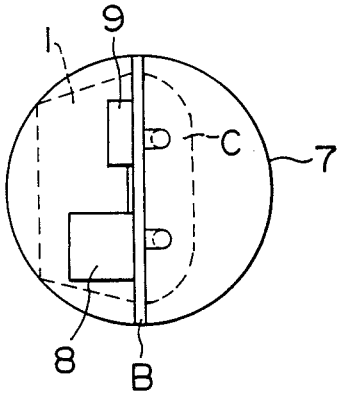

FIGS. 4A–4C show a hybrid configuration (module) of the detonator ignition circuit where the diode-bridge power input circuit 1 and bypass resistor 32 are made in the form of discrete components, as shown in the embodiment of FIG. 2.

Figure 5:
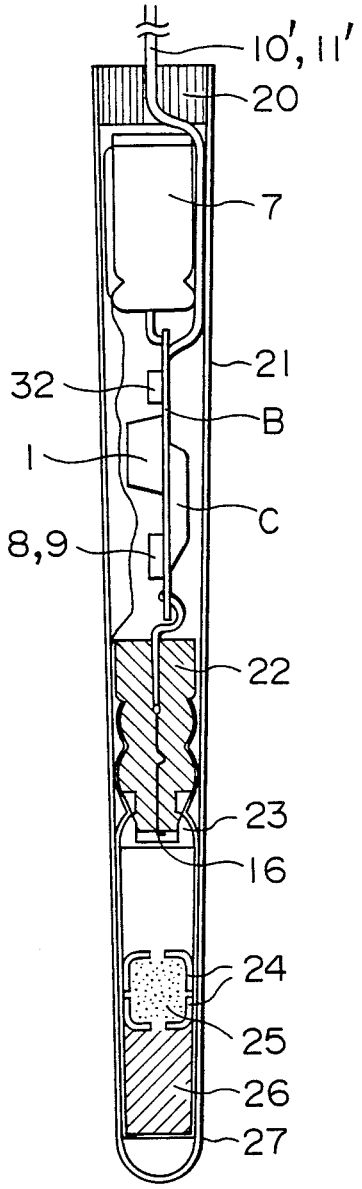
FIG. 5 is a longitudinal sectional view of an overall detonator in accordance with an embodiment of the present invention.
Figure 6:
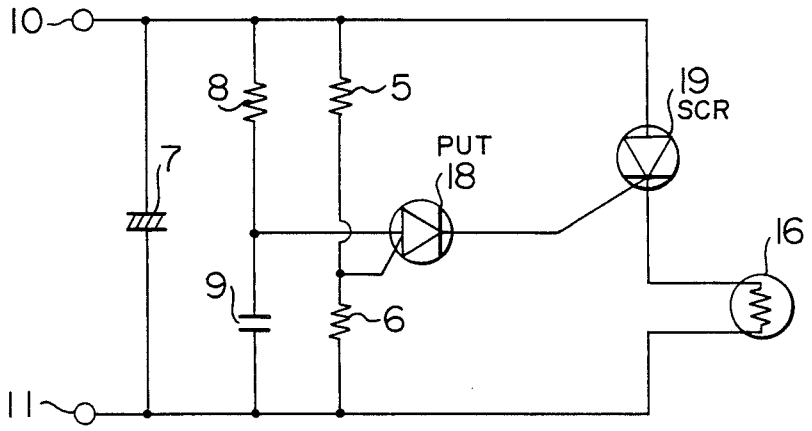
FIG. 6 PRIOR ART
FIG. 6 is a circuit diagram of a prior art analog delay detonator. Here, like reference numerals and characters indicate like parts in the drawings.

FIG. 5 shows an overall view of the electric detonator in accordance with the present invention. Numeral 7 denotes a power electrolytic capacitor, numerals 10' and 11' denote leg wires for lead-out from input terminals 10 and 11, numeral 20 denotes a plug, a plastic cap, numeral 21 denotes a plastic casing, numeral 22 denotes a plastic plug, numeral 23 denotes an ignition agent plastic cup, numeral 24 denotes an inner capsule, numeral 25 denotes a primer charge, numeral 26 denotes a base charge, numeral 27 denote a shell, numeral 16 denotes an ignition resistor, C denotes a monolithic IC package, and B denotes a hybrid IC glass. The ignition time of the detonator with the electronic timer switch constructed in the hybrid IC as shown in FIG. 1 in accordance with the above embodiment was measured. As comparative examples, the ignition times of the electronic delay detonators of the delay powder type and the analog CR circuit type (Japanese Patent Application Laid-Open No. 57-142496) were measured, as shown in the following Table, where $\overline{X}$ indicates a median and o indicates a variance.

| Nominal Time (ms) | Conventional Electric Detonator (delay powder type) $\overline{X}$ (ms) | $\sigma$ | $3\sigma/\overline{X} \times 100$ (%) | Analog CR Delay circuit Detonator (Pat. Appln. Laid Open 57-142496) $\overline{X}$ | $\sigma$ | $3\sigma/\overline{X} \times 100$ (%) | Present Detonator $\overline{X}$ | $\sigma$ | $3\sigma/\overline{X} \times 100$ (%) |
|---|---|---|---|---|---|---|---|---|---|
| 500 | 560 | 39.6 | 21.2 | 495.6 | 14.3 | 8.7 | 499.4 | 3.1 | 1.8 |
| 1000 | 1090 | 48.5 | 13.3 | 992.1 | 13.2 | 4.0 | 999.7 | 3.7 | 1.1 |
| 5100 | 5085 | 158.4 | 9.3 | 5109.2 | 23.6 | 1.4 | 5100.7 | 8.7 | 0.5 |
| 7500 | 7762 | 167.6 | 6.4 | 7518.6 | 37.2 | 1.5 | 7500.2 | 20.4 | 0.6 |

(Measured at 20° C.)

In accordance with the embodiment of the present invention, the compact and inexpensive detonator with the electronic timer switch having a long detonation time and a high timing precision is provided, which comprises the monolithic IC (for example, 2 mm square) and the off-chip power supply capacitor, time setting resistor and time setting capacitor, with the resistors being trimmed by a known automatic trimming apparatus such as an abrasive powder blaster to adjust the setting time.

In accordance with the present invention, the overall circuit of the electronic timer switch including the monolithic IC, the power supply capacitor, the time constant resistor and the time constant capacitor can be formed by a film carrier or glass epoxy or ceramic substrate. Thus, the manufacturing process can be significantly simplified and automated.

The present invention can provide the detonator with the electronic timer which is of practicable cost and construction.

The above timer circuit of IC configuration may be modified by using a bipolar or MOS transistor technologies.

We claim:

1. An electronic delay detonator, in a hybrid IC configuration, for igniting an ignition device through an ignition resistor a predetermined delay time after supply of electrical energy, comprising:

input terminal means for supplying the electrical energy to said electronic delay detonator;

a first capacitor for storing the electrical energy;

release prevention means, connected between said input terminal means and said first capacitor, for preventing the electrical energy supplied through said input terminal means and stored in said first capacitor from being released;

time constant circuit means, connected in parallel with said first capacitor and including a second capacitor and a first resistor, for charging the electrical energy supplied from said input terminal means at a rate whose time constant, which corresponds to said predetermined delay time, is determined by the product of a capacitance of said second capacitor and a resistance of said first resistor;

reference voltage generation circuit means, including a voltage divider connected across said first capacitor, for generating a compare reference voltage;

voltage comparator means for comparing the charged energy of said time constant circuit means with the compare reference voltage of said reference voltage generating circuit means to produce an output signal when the charged energy exceeds the compare reference voltage; and transistor current switching circuit means, responsive to the output signal of said voltage comparator means, for establishing an electrical path to supply the electrical energy stored in said first capacitor to said ignition resistor of said ignition device.

2. An electronic delay detonator according to claim 1 further comprising a signal latch circuit means, connected between said voltage comparator means and said current switching circuit means, for latching the output of said voltage comparator means to drive said transistor current switching circuit means.

3. An electronic delay detonator according to claim 1 further comprising a second resistor connected across said input terminal means, said second resistor dissipating stray currents flowing into said first capacitor.

4. An electronic delay detonator according to claim 3 wherein said second resistor has a constant resistance substantially different from an internal resistance of the electric circuit of said electronic delay detonator.

5. An electronic delay detonator according to claim 2 wherein said compare reference voltage generation circuit means, said voltage comparator means, said signal latch circuit means and said current switching circuit means are assembled in a monolithic bipolar integrated circuit, one end of said ignition resistor of said ignition device is connected to a high potential side of said first capacitor and the other end thereof is connected to a switching transistor of said current switching circuit means, and said current switching circuit means, when it is actuated, establishes a conductive path across said first capacitor to connect the resistor of said ignition device.

6. An electronic delay denotator according to claim 5 comprising an elongated substrate on which said bipolar monolithic integrated circuit, said release prevention means, said first and second resistors and said second capacitor are packaged in a module, and an elongated detonator casing having an inner diameter defined substantially by an outer diameter of said first capacitor, wherein a main surface of said substrate is arranged normally to one end surface of said first capacitor to extend therefrom longitudinally of said casing, and dimensions of a cross section of said module are defined to be no longer than the area of said one end surface of the first capacitor.

7. An electronic delay detonator according to claim 5 wherein said monolithic bipolar integrated circuit has first and second power supply terminals for receiving the electrical energy stored in said first capacitor as a power source, said reference voltage generation circuit means has third and fourth resistors connected in series between said first and second power supply terminals to form a voltage divider, said voltage comparator means has first and second transistors of a first conductivity type and a third load transistor of a second conductivity type to form a differential amplifier, said first transistor has a base electrode to receive the output of said time constant circuit means, said second transistor has a base electrode connected to said third and fourth resistors of said voltage divider, said third transistor has a base electrode connected to said first power supply terminal, a collector electrode of said first transistor and a collector electrode of said second transistor, the output of said voltage comparator means is taken out at the junction of the collector electrodes of said first and third transistors, said signal latch circuit means has fourth and fifth transistors of the second conductivity type having base electrodes receiving the output of said voltage comparator means in parallel and collector electrodes connected to respective load resistors, and sixth and seventh transistors of the first conductivity type driven by the collector outputs of said fourth and fifth transistors and load resistors connected thereto, said sixth transistor has a series circuit of the load resistor and a diode connected between a collector electrode and the first power supply terminal, the junction of said series circuit is connected to a base electrode of said fourth transistor so that the output signal of said voltage comparator means is held as long as substantial energizing charge exists in said first capacitor to cooperate with said fourth transistor and keep said fifth and seventh transistors conductive, said current switching circuit means has an eighth transistor of the second conductivity type which conducts in response to the conduction of said seventh transistor, and ninth and tenth transistors of the first conductivity type having base terminals connected to a collector electrode of said eighth transistors, having collectors connected to terminals connected to one end of said ignition resistor, and having emitter electrodes connected to the second power supply terminal, and the emitter electrode of said ninth transistor is connected to the base electrode of said tenth transistor.

8. An electronic delay detonator according to claim 1 wherein said first capacitor has a capacitance of several hundreds $\mu$F, said second capacitor has a capacitance of 0.001–10 $\mu$F, and said first resistor has a resistance of several tens k$\Omega$ – 10 M$\Omega$.

9. An electronic delay detonator according to claim 1 wherein said release prevention means includes a plurality of bridge-connected diodes or a plurality of doubler-connected diodes.

10. An electronic delay detonator circuit for igniting a plurality of serially connected detonators comprising:

first and second power input lines;

a diode bridge circuit having a first pair of opposite junctions connected between said first and second power input lines and a second pair of opposite junctions providing a bridge connection with said first pair of opposite junctions;

storing means, connected between said second pair of opposite junctions of said diode bridge circuit, for storing electrical energy supplied from said power input lines;

delay means connected between said second pair of opposite junctions, for producing an output when energy stored in said energy storing means reaches a predetermined amount;

means for igniting one of said serially connected detonators in response to said output; and a resistor connected between said first pair of opposite junctions, and in parallel with said first and second power input lines, said resistor having a constant resistance substantially larger than an internal resistance of the electric circuit of said electronic delay detonator so as to dissipate stray current and allow counting of a number of said serially connected detonators.

11. An electronic delay detonator according to claim 10 wherein said resistor is predetermined at a constant resistance of 10$\Omega$ up to 500$\Omega$.

12. A method for testing connection of electronic delay detonators, comprising the steps of:

(a) providing a desired number of electronic delay detonators;

each of said electronic delay detonators comprising first and second power input lines for externally receiving electrical energy, storing means connected to said first and second power input lines for storing the electrical energy, prevention means connected between said storing means and said input lines for preventing said stored energy from being released, delay means connected to said first and second power input lines for producing an output when the energy stored in said storing means reaches a predetermined amount, switching means responsive to the output of said delay means for momentarily supplying the electrical energy of said storing means to an ignition resistor, and a bypass resistor connected between said first and second power input lines and having a predetermined constant resistance distinguishably larger than an internal resistance of the detonator switching circuit in a non-actuated state and smaller than a predetermined value;

(b) serially connecting said first and second power input lines of said detonators so as to form a blasting detonator circuit connection;

(c) measuring a series resistance of said blasting detonator circuit connection in the non-actuated state; and (d) determining a status of connection based on the measured resistance relative to the predetermined constant resistances of said bypass resistors.

* * * * *

UNITED STATES PATENT AND TRADEMARK OFFICE

CERTIFICATE OF CORRECTION

PATENT NO. : 4,712,477

DATED : December 15, 1987

INVENTOR(S) : KENICHI AIKOU ET AL.

It is certified that error appears in the above-identified patent and that said Letters Patent is hereby corrected as shown below:

Column 9, line 28, "denotator" should be --detonator--.

Signed and Sealed this

Twelfth Day of July, 1988

*Attest:*

DONALD J. QUIGG

*Attesting Officer*

*Commissioner of Patents and Trademarks*